US010039345B2

(12) United States Patent
Ha et al.

(10) Patent No.: US 10,039,345 B2
(45) Date of Patent: Aug. 7, 2018

(54) WIRE TIGHTENING APPARATUS

(71) Applicant: SHIN KYUNG INC., Busan (KR)

(72) Inventors: Gi Ho Ha, Busan (KR); Young Ho Ha, Busan (KR); Hyun Il Kim, Busan (KR)

(73) Assignee: SHIN KYUNG INC., Busan (KR)

( * ) Notice: Subject to any disclaimer, the term of this patent is extended or adjusted under 35 U.S.C. 154(b) by 0 days.

(21) Appl. No.: 15/306,091

(22) PCT Filed: Mar. 31, 2015

(86) PCT No.: PCT/KR2015/003143
§ 371 (c)(1),
(2) Date: Oct. 22, 2016

(87) PCT Pub. No.: WO2015/163594
PCT Pub. Date: Oct. 29, 2015

(65) Prior Publication Data

US 2017/0042289 A1 Feb. 16, 2017

(30) Foreign Application Priority Data

Apr. 24, 2014 (KR) ..... 10-2014-0049124

(51) Int. Cl.
*A43C 7/00* (2006.01)
*A43C 7/08* (2006.01)
(Continued)

(52) U.S. Cl.
CPC ..... *A43C 7/08* (2013.01); *A43C 11/16* (2013.01); *A44B 99/00* (2013.01); *B65H 75/30* (2013.01);
(Continued)

(58) Field of Classification Search
CPC ..... A43C 7/08; A43C 11/16; A43C 11/165; Y10T 24/218; Y10T 24/2183; Y10T 24/216; Y10T 24/3724
See application file for complete search history.

(56) References Cited

U.S. PATENT DOCUMENTS 8,245,371 B2 8/2012 Chen
9,706,814 B2 * 7/2017 Converse ..... A43C 11/165
(Continued)

FOREIGN PATENT DOCUMENTS

JP 8-503868 A 4/2006
KR 10-0953398 B1 4/2010
(Continued)

OTHER PUBLICATIONS

English Translation of the Written Opinion of the International Search Authority, of PCT/KR2015/003143, dated Jun. 23, 2015.*

*Primary Examiner* — Robert Sandy
*Assistant Examiner* — Michael S Lee
(74) *Attorney, Agent, or Firm* — Maschoff Brennan

(57) ABSTRACT

A wire tightening apparatus includes a housing having a ratchet gear formed in its inner periphery in a circumferential direction. A winding member is rotatably inserted into the housing, with a wire being wound therearound. A support part radially protrudes from the upper portion of a coupling shaft coupled to the housing. An intermediate member includes an engagement restriction part that is engaged with the ratchet gear and is restricted from rotating. The intermediate member has a resilient coupling hole in its center, with a resilience restriction part on the periphery thereof. The engagement restriction part is provided on an end of a blade extending from a body and having a resilient support force. The resilience restriction part is elevated by an external force coupled to the upper portion of the winding
(Continued)

member and is supported by the outer periphery of the support part in lifted and lowered states.

4 Claims, 4 Drawing Sheets

(51) Int. Cl.

| | |
|---|---|
| ***A44B 99/00*** | (2010.01) |
| ***A43C 11/16*** | (2006.01) |
| ***B65H 75/30*** | (2006.01) |
| ***B65H 75/44*** | (2006.01) |

(52) U.S. Cl.
CPC ..... *B65H 75/4431* (2013.01); *Y10T 24/216* (2015.01); *Y10T 24/2183* (2015.01); *Y10T 24/3724* (2015.01)

(56) References Cited

U.S. PATENT DOCUMENTS

| | | | | |
|---|---|---|---|---|
| 2010/0299959 | A1* | 12/2010 | Hammerslag ..... | A43B 5/1666 36/50.5 |
| 2011/0266384 | A1 | 11/2011 | Goodman et al. | |
| 2013/0025100 | A1 | 1/2013 | Ha | |
| 2015/0014463 | A1* | 1/2015 | Converse ..... | A61F 5/0118 242/396.1 |

FOREIGN PATENT DOCUMENTS

| | | | |
|---|---|---|---|
| KR | 10-0978881 | B1 | 8/2010 |
| KR | 10-1099458 | B1 | 12/2011 |
| KR | 10-2013-0040141 | A | 4/2013 |
| KR | 10-2013-0100238 | A | 9/2013 |

* cited by examiner (Prior Art)

WIRE TIGHTENING APPARATUS

TECHNICAL FIELD

The present invention relates to a wire tightening apparatus, and in particular to a wire tightening apparatus wherein the wire tightening apparatus can be configured into a simplified form, and an assembling procedure can be convenient, for which the productivity and durability may be greatly enhanced.

BACKGROUND

The shoes, for example, sneakers, etc. are equipped with a shoestring tied in a zigzag shape, thus allowing the shoes to tightly fit to a user's foot size. The tight fitting between the shoes and the user's feet can be improved by pulling and tightening the shoestrings, whereby a convenient walking can be achieved.

However, for the elementary school students of lower grades or kids before the elementary school or senior citizens, the loosening and tightening procedures of the shoestrings are not easy. For athletes and ordinary persons who do exercises, for example, a mounting climbing and a cycle racing, if both ends or a knotted portion of the shoestring are not fixed and untied when it is caught through an intense action or by an external thing, a racing record may be lowered, and an accident may occur, thus causing an undesired result. For this reason, the shoestrings should not be untied. Moreover, the tightly tied shoestrings should be easily untied when the user takes a rest after exercise for the sake of effective relaxation. Most preferably, the shoestrings should be easily tied, and at the same time, the tied states should be maintained in place, and the tied shoestrings should be easily loosened, if necessary.

A variety of devices are developed, which are able to easily tighten the shoestrings, thus facilitating the tightening and loosening of the shoestrings the procedures of which are opposite. The applicant of the present invention has an invention with the Korean patent NO. 953398 entitled "a device for tightening shoestrings using a ratchet gear".

FIG. 1 is a perspective view illustrating a shoe equipped with a shoestring tightening device, and FIG. 2 is a disassembled perspective view illustrating a conventional device for tightening shoestrings.

As illustrated in FIGS. 1 and 2, the conventional shoestring tightening device 10 is provided at a shoe tongue (T), wherein when a rotation cover 51 is rotated, an intermediate member 53 and a winding member 55 are engaged and rotate together. The shoestring (L) is wound around the winding member, and a shape-fitting restriction part 53*z* of the intermediate member is restricted by a one-direction latch gear 57*c* of a housing 57, so the rotation thereof is limited, not rotating in the opposite direction.

If the rotation cover 51 is pulled upward, an engaging shoulder part 123 of a rotary shaft 61 may move upward while resiliently pressing and splitting a resilient means 59, by which the intermediate member 53 can move upward. In this way, the engaged state between the intermediate member 53 and the winding member 55 is eliminated, after which the winding member 55 can freely rotate. Consequently, the shoestrings (L) can be pulled and loosened.

For this operation, it needs to separately manufacture a resilient means 59 which is made of a metal and is configured in a U-shape and should be assembled to a shoestring tightening device 10 through a complicated assembling procedure.

Moreover, the aforementioned shoestring tightening device 10 may have a problem wherein if the rotation cover 51 is pulled upward so as to untie the shoestring, the product may have an error if the resilient means 59 separates out of its original position. For this reason, the durability and reliability of the product may be degraded. If the lower structure of the housing 57 to which the resilient means 59 is engaged, is transformed complicated in an effort to resolve such problems, the whole configuration may become complicated, and the number of necessary components may increase, whereby the productivity of the product may be degraded.

RELATED ART DOCUMENT

Patent document 1: The Korean patent NO. 10-0953398

DISCLOSURE OF INVENTION

Technical Problem

Accordingly, the present invention are directed to providing a wire tightening apparatus wherein the wire tightening apparatus can be configured in a simplified form, and an assembling procedure can be convenient, for which the productivity and durability may be greatly enhanced.

Technical Solution

The present disclosure provides a wire tightening apparatus, which may include, but is not limited to, a housing having a ratchet type of gear formed in the inner periphery thereof in a circumferential direction; a winding member inserted into the housing so as to be rotatable, a wire being selectively wound around the winding member; a support part radially protruding from the upper portion of a coupling shaft of which the lower portion is coupled to the housing; and an intermediate member that includes an engagement restriction part selectively engaged with the ratchet type of gear and restricted from rotating in a direction, and has a resilient coupling hole formed in the center thereof, the periphery of which a resilience restriction part is formed on, wherein the engagement restriction part is provided on an end portion of a blade part extending from a body part and having a resilient support force, and the resilience restriction part is elevated by an external force to be selectively coupled to the upper portion of the winding member and is supported by the outer periphery of the support part in a lifted state and in a lowered state.

Herein, the resilient restriction part includes the first mounting part and the second mounting part which are disposed in a multi-layer structure in the upward and downward directions at the rim of the resilient coupling hole, thus allowing the supported by the outer periphery of the support part to be selective mounted, wherein the first mounting part is disposed at the upper portion a resilient piece which is protruding upward to be resiliently split wide as the support part selectively passes when the external force is applied to the intermediate member.

At this time, a guide part gradually inclined outward of the radius direction and in the downward direction and an engaging part inclined inside of the radius direction are formed at the upper side and the lower side of the outer periphery of the support part, and the inner periphery of the resilient piece is inclined to shape-fit with the guide part.

Moreover, the first mounting part and the second mounting part are disposed in a radial direction alternately along the circumferential direction.

Meanwhile, an engaging shape-fitting part and an engaging and coupling part are formed at the upper portion of the winding member and the lower portion of the intermediate member and are selectively shape-fit with each other and are engaged, and a rotation cover is engaged to the upper portion of the intermediate member in such a way that it can operate integral in the rotation direction and the upward and downward directions so as to transfer an external force.

Advantageous Effects

The wire tightening apparatus according to the present invention has the following effects through the aforementioned resolutions.

First, the wire tightening apparatus allows to conveniently and stably tighten or loosen shoestrings through a simplified procedure, thus greatly enhancing the quality and reliability of the products. The wire tightening apparatus is configured in such a way that a resilient restriction part is provided integral at an intermediate member, wherein the resilient restriction part is employed as a means to maintain an lifting state for selectively eliminating the engaged state between the intermediate member and the winding member, for which the number of the necessary components can be reduced, and an assembling procedure can be simplified, thus enhancing the economic feasibility and productivity.

Second, the resilient restriction part is formed integral at the rim of a resilient engagement hole formed at a central portion of the intermediate member, so it may not be separated or lost. The durability can be greatly enhanced.

Third, since the wire tightening apparatus can be used attached to sneakers or various shoes, the attachments of the wire tightening apparatus of the present invention may contribute to differentiation as compared to other products, which may allow for an increased market competitiveness.

MODES FOR CARRYING OUT THE INVENTION

The wire tightening apparatus according to a preferred embodiment of the present invention will be described with reference to the accompanying drawings.

Figure 1:
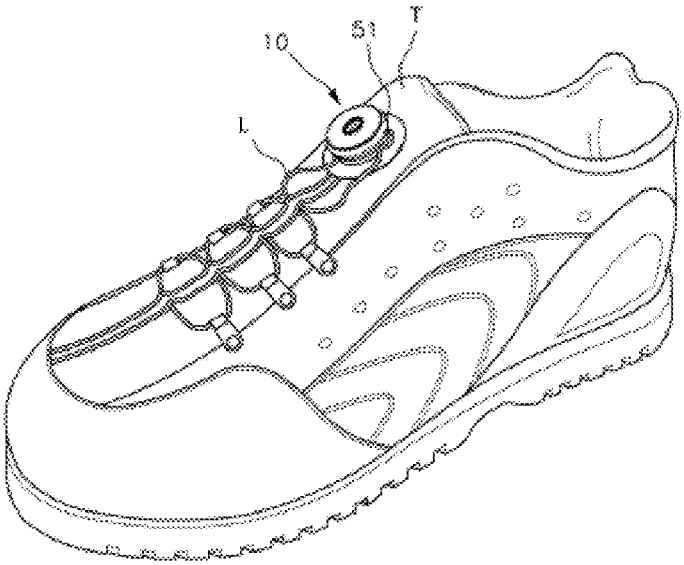
FIG. 1 is a perspective view illustrating a shoe wherein a shoestring tightening apparatus is engaged.
Figure 2:
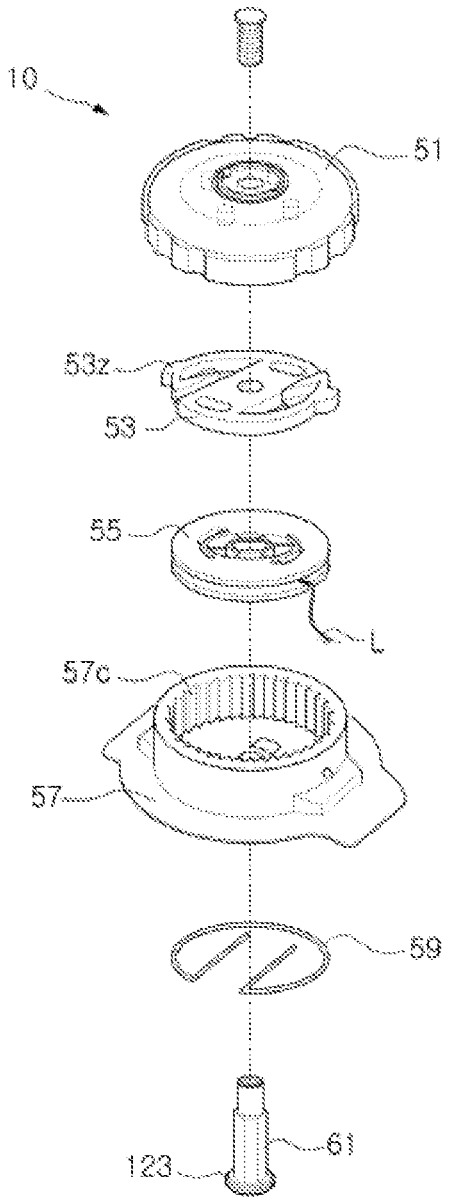
FIG. 2 is a disassembled perspective view illustrating a conventional shoestring tightening apparatus.
Figure 3:
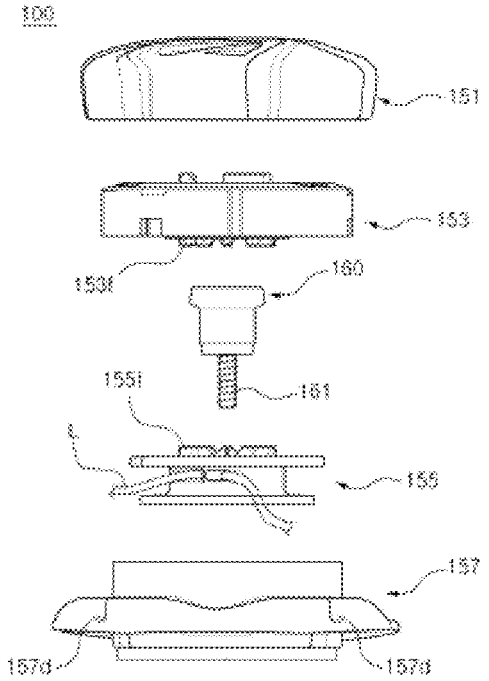
FIG. 3 is a disassembled side view illustrating a wire tightening apparatus according to an exemplary embodiment of the present invention.
Figure 4:
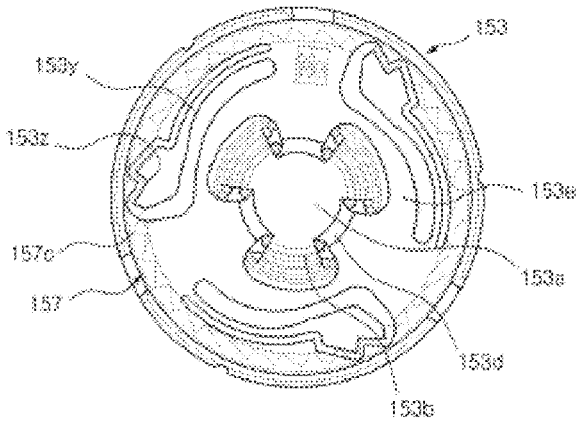
FIG. 4 is a sectional plan view illustrating a relationship between an intermediate member and a ratchet gear according to an exemplary embodiment of the present invention.

FIG. 3 is a disassembled side view illustrating a wire tightening apparatus according to an exemplary embodiment of the present invention. FIG. 4 is a sectional plan view illustrating a relationship between an intermediate member and a ratchet type of gear according to an exemplary embodiment of the present invention.

As illustrated in FIGS. 3 and 4, the wire tightening apparatus 100 may include, but is not limited to, a housing 157, a winding member 155, a support part 160 and an intermediate member 153.

A circumferential one-direction ratchet type of gear (157*c* in FIG. 4) is formed at the upper of an inner periphery of the housing 157. It is preferred that through holes 157*d* through which the wire (L) used as a shoestring passes through to the outside, are formed at a previously set side portion.

Moreover, a winding member 155 around which the wire (L) is selectively wound, may be inserted rotatable at the inner side of the housing 157. As the winding member 155 rotates in the clockwise direction or the counterclockwise direction by an external force, the wire (L) can be wound or unwound. Moreover, a lower portion of the engaging shaft 161 is engaged to the housing 157, and a support part 160 protruding in the radius direction along the circumferential direction may be provided at the top of the engaging shaft 161.

Meanwhile, a shape-fitting restriction part 153*z* may be provided at an end portion of a wing part 153*y* formed extending with a resilient support force from a body part 153*e* of the intermediate member 153, wherein the shape-fitting restriction part 153*z* is selectively shape-fit to the ratchet type of gear 157*c*, so a one-direction rotation thereof can be restricted.

More specifically, the one-direction represents the direction where the intermediate member 153 can rotate as the shape-fitting restriction part engaged to the ratchet type of gear 157*c* slides along the inclined plane, and the wing part 153*y* is resiliently transformed inward. In FIG. 4, it can be expressed in the way that the intermediate member 153 wherein the shape-fitting restriction part 153*z*, can rotate in the clockwise direction with respect to the ratchet type of gear 157*c* of the housing 157 indicated by the dotted line.

The shape-fitting restriction part 153*z* provided at an end of the wing part 153*y* may rotate along the gear tooth of the ratchet type of gear 157*c* by an external force. The wing part 153*y* will be bent inward, and then will return back to the original shape by means of the operation of the resilient recovery force at the next gear tooth. Since the wing part 153*y* repeatedly carries out the aforementioned operations, the intermediate member 153 can be rotated in the clockwise direction while providing a click feeling to the user. Since the wing part 153*y* will return to its original shape in the counterclockwise direction, the shape-fitting restriction part 153*z* can be completely fitted into the ratchet type of gear 157*c* and is restricted, by which the intermediate member does not rotate.

In this way, the circumferential one-direction ratchet type of gear 157*c* may allow the intermediate member 153 to rotate in one direction, but it restricts the rotation in the opposite direction. Since the one direction which is rotatable, can be set so that the intermediate member can rotate in the clockwise direction by changing the shapes of the ratchet type of gear and the shape-fitting restriction part, and the design thereof can be changed so that it can rotate in the counterclockwise direction.

In addition, an engaging shape-fitting part 155*f* and an engaging and coupling part 153*f* may be formed in the circumferential direction at the upper portion of the winding member 155 and the lower portion of the intermediate member 153, wherein the engaging shape-fitting part 155*f* and the engaging and coupling part 153*f* are selectively shape-engaged with each other. Here, it is preferred that at least any one between the engaging shape-fitting part 155*f* and the engaging and coupling part 153*f* is formed protruded in the shape of a gear. In this way, if the intermediate member 153 ascends, the engaged state between the engaging shape-fitting part 155*f* and the engaging and coupling part 153*f* is eliminated, and the winding member 155 becomes a free rotation state.

For this, a resilient coupling hole 153*a* wherein a resilient restriction part is formed at a rim thereof, may be formed at a central portion of the intermediate member 153. As the intermediate member elevates by an external force, the resilient restriction part is supported so that the ascended and descended state thereof can be maintained by the circumference of the support part 160, by which the intermediate member 153 may allow the winding members to be selectively engaged or separated. More specifically, if the intermediate member 153 ascends, the engaged state between the engaging shape-fitting part 155*f* and the engaging and coupling part 153*f* may be eliminated, and on the contrary, if the intermediate member 153 descends, the engaging shape-fitting part 155*f* and the engaging and coupling part 153*f* are engaged with each other.

Moreover, a hook engaging method and an adhesive engaging method are adapted to the upper and outer side portion of the intermediate member 153 so as to supply transfer an external force so that the rotation cover 151 can operate integrally in the rotation direction and the upward and downward directions.

In this way, the user is able to tighten the wire (L) by rotating the rotation cover 151 in one direction, and on the contrary, when it needs to loosen the wire (L), the rotation cover 151 is ascended, and the engaged state between the intermediate member 155 and the winding member 155 is eliminated, and both ends of the wire (L) are pulsed, thus loosening the wire (L).

Figure 5A:
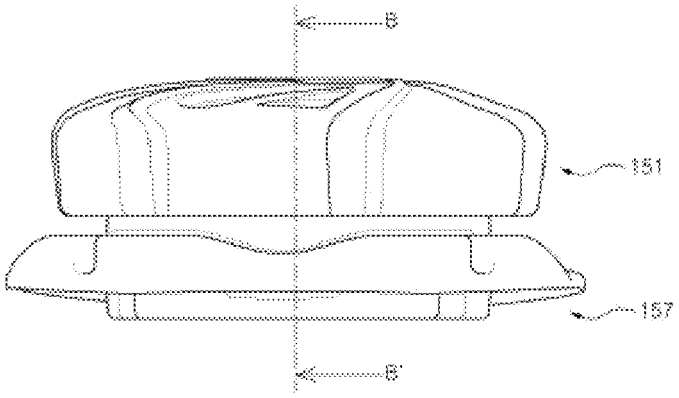
FIG. 5*a* is a side view when a wire of a wire tightening apparatus is being wound according to an exemplary embodiment of the present invention.
Figure 5B:
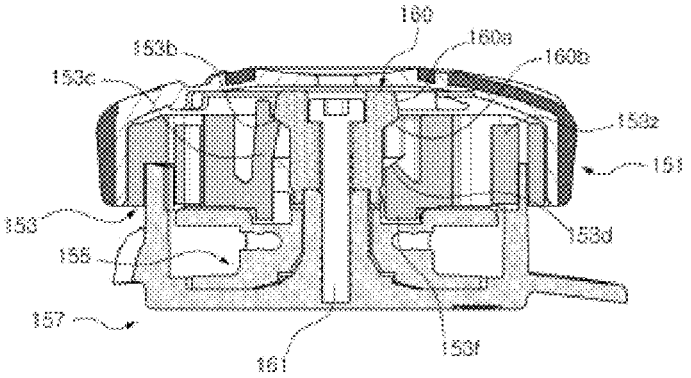
FIG. 5*b* is a side projection view illustrating a wire tightening apparatus when viewing from the C-C" direction in FIG. 5*a*.

Meanwhile, FIG. 5*a* is a side view when a wire of a wire tightening apparatus is being wound according to an exemplary embodiment of the present invention, and FIG. 5*b* is a side projection view illustrating a wire tightening apparatus when viewing from the B-B' direction in FIG. 5*a*.

As illustrated in FIGS. 5*a* and 5*b*, the resilient restriction part may include the first mounting part 153*b* and the second mounting part 153*d* which are disposed in a multi-layer structure in the upward and downward directions at the rim of the resilient engaging groove 153*a* and are disposed in the upward and downward directions for the circumference of the support part 160 to be selectively mounted. It is preferred that the resilient restriction part may be injected and molded integral when manufacturing the intermediate member 155.

In a state where the rotation cover 151 and the intermediate member 153 descend integral with each other, and the support part 160 is mounted on the upper surface of the first mounting part 153*b*, the engaging and coupling part 153*f* of the intermediate member 153 and the engaging shape-fitting part (155*f* in FIG. 6*b*) of the winding member 155 are engaged with each other, and the winding member 155 is rotated only in one direction, and the rotation thereof in the opposite direction is restricted. In this way, the user can easily tighten the wire (L) by winding the wire around the winding member 155 in such a way to rotate the rotation cover 151 in one direction.

Referring to FIG. 4, it is preferred that the first mounting part 153*b* and the second mounting part 153*d* are disposed in a radial shape alternately along the circumferential direction. The first mounting part 153*b* may be formed on the tops of the resilient pieces (153*c* in FIG. 5*b*) which is formed protruding upward to be split wide for the support part 160 to selectively pass as an external force is transferred to the intermediate member 153 through the rotation cover 151.

Figure 6A:
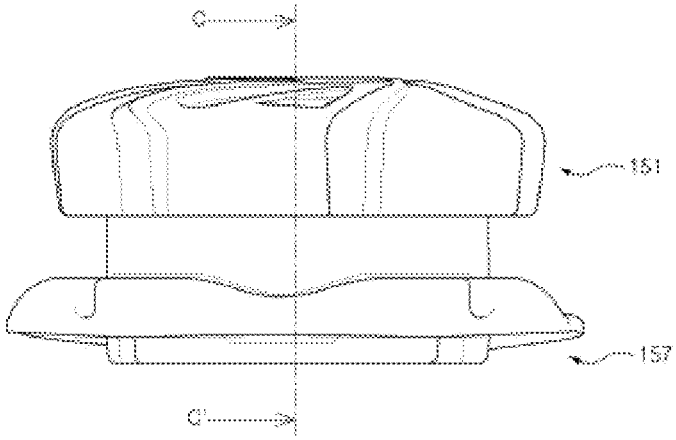
FIG. 6*a* is a side view when a wire of a wire tightening apparatus is being loosened according to an exemplary embodiment of the present invention.
Figure 6B:
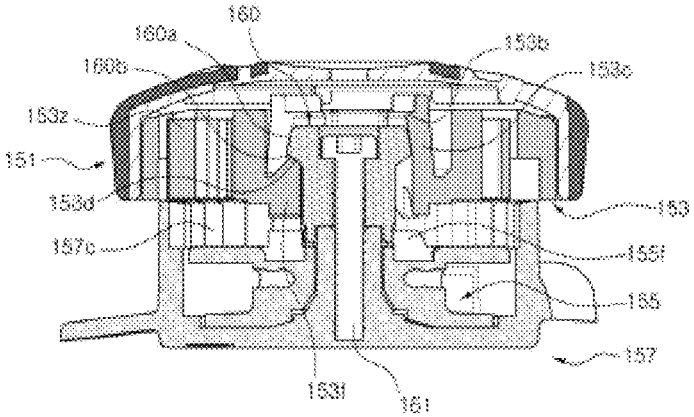
FIG. 6*b* is a side projection view illustrating a wire tightening apparatus when viewing from the C-C" direction in FIG. 6*a*.

FIG. 6*a* is a side view when a wire of a wire tightening apparatus is being loosened according to an exemplary embodiment of the present invention, and FIG. 6*b* is a side projection view illustrating a wire tightening apparatus when viewing from the C-C" direction in FIG. 6*a*.

As illustrated in FIGS. 6*a* and 6*b*, if the rotation cover 151 and the intermediate member 153 are pressed upward as an external force is applied to the rotation cover 151, the resilient piece 153*c* connected to the first mounting part 153*b* will contact with the circumference of the support part 160 and will be pressed. In this way, the resilient piece 153*c* is split wide, and the support part 160 will pass through the space between the first mounting parts 153*b* and will be mounted on the upper surface of the second mounting part 153*d* disposed at a lower side thereof.

In a state where the rotation cover 151 and the intermediate member 153 has ascended integral, and the support part 160 has been mounted on the upper surface of the second mounting part 153*d*, the engaged state between the engaging and coupling part 153*f* of the intermediate member 153 and the engaging shape-fitting part 155*f* of the winding member 155 is eliminated, and the winding member 155 becomes a free rotation state. In this way, when the user pulls the wire (L) which is exposed to the outside, the winding member 155 becomes a free rotation state, and the wire (L) can be easily unwound.

Meanwhile, a guide part 160*a* gradually inclined outward of the radius direction and in the downward direction and an engaging part 160*b* gradually inclined inward of the radius direction are formed at the upper and lower portions of the outer periphery of the support part 160, so the outer periphery surface thereof are preferably formed in the shape of " <> " in whole.

If the rotation cover 151 and the intermediate member 153 descend integral by an external force through a user's operation, the guide part 160*a* will pass while contracting inward the resilient piece 153*c* and the first mounting part 153*b*, so the engaging part 160*b* will be mounted on the upper surface of the first mounting part 153*b*.

At this time, the inner periphery of the resilient piece 153*c* is preferably formed inclined to shape-fit with the guide part 153*c*, thus securing a stable movement during the sliding contact.

Meanwhile, in a state where the engaging part 160*b* has been mounted at the second mounting part 153*d*, the guide part 160*a* is shape-fit with the inner periphery surface of the resilient piece 153*c*, so the intermediate member 153 is able to maintain a stable mounted state without being moved upward or downward by an external force, thus preventing the occurrence of any noise. On the contrary, in a state where the engaging part 160*b* is mounted at the first mounting part 153*b*, the lower portion of the intermediate member 153 will contact close with the winding member 155, so the intermediate member 153 is able to maintain a stable mounted state without being moved upward or downward by an external movement, thus preventing the occurrence of noise.

Since the wire tightening apparatus 100 is configured in such a way that the resilient restriction part is formed integral at the intermediate member 153, wherein the resilient restriction part is provided as a means to maintain an elevating state to selectively eliminate the engaged state between the intermediate member 153 and the winding member 155, thus reducing the number of necessary components, and the assembling procedure is simple, so the productivity and durability can be enhanced.

In the wire tightening apparatus 100, since the wire (L) used as a shoestring, etc. can be tightened or loosened conveniently and stably through a simplified procedure, the quality and reliability of the product can be promoted, and since it can be used attached to sneakers or a predetermined thing which needs the tightening through various wires, a wire tightening apparatus 100 attachments may contribute to differentiation from other products, thus obtaining the market competitiveness of the product.

The use of the wire tightening apparatus 100 according to the present invention is not limited to the tightening of the shoestrings. It may be adapted to a variety of devices which are configured to tighten strings. It is obvious that the application thereof to other device to which the technical principle of the present invention have been applied, belongs to the right scope of the present invention.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

*Legend of Reference Numbers*

| | |
|---|---|
| 100: Wire tightening device | 151: Rotation cover |
| 153: Intermediate member | 153a: Resilient coupling hole |
| 153b: First mounting part | 153c: Resilient piece |
| 153d: Second mounting part | 153f: Engaging and coupling part |
| 153z: Latch shape-fitting part | 155: Winding member |
| 155f: Engaging shape-fitting part | 157: Housing |
| 157c: Ratchet type of gear | 160: Support part |
| 160a: Guide part | 160b: Engaging part |
| L: Wire | |

What is claimed is:

1. A wire tightening apparatus, comprising:

a housing wherein a circumference one-direction ratchet type of gear is disposed at an inner periphery thereof;

a winding member which is inserted into the housing so as to be rotatable, wherein a wire is selectively wound there around ;

a support part which is provided protruding from an upper portion of a coupling shaft of which a lower portion is coupled to the housing; and an intermediate member which includes an engagement restriction part which is selectively engaged with the ratchet type of gear and restricted from rotating in a direction, and having a resilient coupling hole formed in the center thereof, the periphery of which a resilience restriction part is formed on, wherein the engagement restriction part is provided on an end portion of a blade part extending from a body part and having a resilient support force, and the resilience restriction part is elevated by an external force from a lowered state to a lifted state to be selectively coupled to the upper portion of the winding member and is abutted by the outer periphery of the support part in the lowered state, wherein the resilience restriction part includes a first mounting part and a second mounting part which are disposed in a multi-layer structure in upward and downward directions at the rim of the resilient coupling hole, thus allowing a side face of the outer periphery of the support part to be selectively mounted, the side face angled relative to the top face and the side face being a mounting face of the outer periphery positioned between the top face and the coupling shaft, and wherein the first mounting part is disposed at the top of a resilient piece which is protruding upward to be resiliently split wide as the support part selectively passes when the external force is applied to the intermediate member.

2. The apparatus of claim 1, wherein a guide part gradually inclined outward of the radius direction and in the downward direction and an engaging part inclined inward of the radius direction and in the downward direction are formed at an upper portion and a lower portion of the outer periphery of the support part, and the inner periphery of the resilient piece is inclined to shape-fit with the guide part.

3. The apparatus of claim 1, wherein the first mounting part and the second mounting part are disposed in a radial direction alternately along the circumference direction.

4. The apparatus of claim 1, wherein an engaging shape-fitting part and an engaging and coupling part are formed at the upper portion of the winding member and the lower portion of the intermediate member respectively and are selectively engaged and shape-fit with each other, and a rotation cover is engaged to the upper portion of the intermediate member in such a way that it can operate integrally in the rotation direction and the upward and downward directions so as to transfer an external force.

* * * * *